US006948791B2

(12) United States Patent
Togashi et al.

(10) Patent No.: US 6,948,791 B2
(45) Date of Patent: Sep. 27, 2005

(54) LIQUID EJECTING APPARATUS

(75) Inventors: Takayuki Togashi, Nagano (JP); Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/606,222

(22) Filed: Jun. 26, 2003

(65) Prior Publication Data

US 2004/0066425 A1 Apr. 8, 2004

(30) Foreign Application Priority Data

Jun. 26, 2002 (JP) ..... P2002-186720

(51) Int. Cl.[7] ..... B41J 29/38
(52) U.S. Cl. ..... 347/14
(58) Field of Search ..... 347/10, 11, 14, 347/19, 50, 68

(56) References Cited

U.S. PATENT DOCUMENTS

| | | | | | |
|---|---|---|---|---|---|
| 5,289,210 | A | * | 2/1994 | Takayanagi | 347/14 |
| 6,050,665 | A | * | 4/2000 | Kishi | 347/14 |
| 6,068,360 | A | * | 5/2000 | Hiwada | 347/14 |
| 6,168,252 | B1 | * | 1/2001 | Yaji | 347/14 |
| 6,334,660 | B1 | * | 1/2002 | Holstun et al. | 347/19 |
| 6,398,331 | B1 | * | 6/2002 | Asaka et al. | 347/9 |
| 2002/0018085 | A1 | * | 2/2002 | Asauchi et al. | 347/10 |
| 2003/0146742 | A1 | * | 8/2003 | Nishida et al. | 324/76.11 |

FOREIGN PATENT DOCUMENTS

| | | | |
|---|---|---|---|
| JP | 02-299293 | A | 12/1990 |
| JP | 08-174841 | A | 7/1996 |
| JP | 11-058729 | A | 3/1999 |
| JP | 2000-263818 | A | 9/2000 |
| JP | 2001-150677 | A | 6/2001 |
| JP | 2001-270092 | A | 10/2001 |
| JP | 2001-270111 | A | 10/2001 |
| JP | 2002-29042 | A | 1/2002 |
| JP | 2002-019092 | A | 1/2002 |
| JP | 2002-036535 | A | 2/2002 |

* cited by examiner

*Primary Examiner*—Thinh Nguyen
(74) *Attorney, Agent, or Firm*—Sughrue Mion, PLLC

(57) ABSTRACT

A liquid ejecting apparatus includes a liquid ejecting head formed with a nozzle opening from which a liquid droplet is ejected, and having a driving voltage information ID in a reference state specific to each liquid ejecting head, a pressure generating chamber communicating with the nozzle opening, a piezoelectric vibrator, expanding and contracting the pressure generating chamber, a driving signal generator generating a driving signal to displace the piezoelectric vibrator, a switch, selectively applying the driving signal to the piezoelectric vibrator based on liquid ejecting data, and a flexible flat cable transmitting the driving signal to the piezoelectric vibrator. A voltage obtained by adding a correction coefficient to a voltage specified in the driving voltage information ID is used as a reference driving voltage.

8 Claims, 8 Drawing Sheets

LIQUID EJECTING APPARATUS

BACKGROUND OF THE INVENTION

The present invention relates to a liquid ejecting apparatus equipped with a liquid ejecting head from which liquid droplets are ejected through nozzle openings by pressurizing a pressure generating chamber using pressure generator.

A summary of a driving method of a related liquid ejecting head in an inkjet serial printer system as an example of a liquid ejecting apparatus will now be described with reference to the accompanying drawings.

FIG. 1 is a view showing a relation between a liquid ejecting apparatus main body (hereinafter, referred to as the main body) 1 and a liquid ejecting head. The main body 1 performs information processing and supplies driving power to the liquid ejecting head 2 as a subject to be controlled. The main body 1 includes a control circuit 3 that creates data used to determine nozzle(s) which ejects liquid droplets and provides timing, a driving signal generating circuit 4 that generates a driving signal for driving actuators (9 through 11) of the liquid ejecting head 2, transistors 5 and 6 that amplify the driving signal generated in the driving signal generating circuit 4, and a connector 7 that outputs control data and driving power to the liquid ejecting head 2. The liquid ejecting head 2 includes a connector 8 into which a driving signal waveform from the driving signal generating circuit 4 is inputted, a plurality of actuators 9 through 11 having piezoelectric vibrators that generate kinetic energy needed to eject liquid droplets, analog switches 12 through 14 that control the driving signal waveform from the actuator main bodies, and a control circuit 15 that controls vibrations of the actuators 9 through 11 through ON/OFF operations of the analog switches 12 through 14 according to data from the control circuit 3 in the main body 1. The liquid ejecting head 2 reciprocates on the guide within a liquid ejecting apparatus mechanism, and receives data corresponding to the position on the guide from the main body 1, whereupon it ejects liquid droplets and hence performs printing. The main body 1 and the ejecting head 2 are connected to each other through a flexible flat cable (hereinafter, abbreviated to FFC) 16. As shown in FIG. 2, the FFC 16 is shaped like a strip, including a number of conducting lines used as conduction patterns 17 that are aligned in parallel to one another and molded in synthetic resin 18 having good flexibility and durability to withstand bending deformation so as not to interfere with reciprocating motions of the liquid ejecting head 2. In order to provide the conducting patterns 17 per se with the same durability as that of the synthetic resin 18, the conduction patterns 17 include a thin-plate member made of copper alloy, patterned into narrow slips.

The conduction patterns 17 are formed of driving signal lines of the piezoelectric vibrators, earth lines, temperature-detecting signal lines, other driving power supply lines, etc., which are determined by the number of kinds of liquid. Recently, in order to meet the need to improve a printing quality or the like, not only the kinds of liquid, but also the kinds of signals to be inputted into the liquid ejecting head 2 from the driving signal generating circuit 4 have to be increased, so that the liquid ejecting apparatus adapts to the environments, such as temperature and humidity, at a site where a recording apparatus is installed.

Meanwhile, a liquid ejecting head 2 and a liquid ejecting apparatus that comply not only with a conventional consumer apparatus (A-size), but also with an apparatus for large format printer (hereinafter, abbreviated to LFP) of an A0/B0 size have now become commercially available with the expansion in application of the liquid ejecting apparatus, and the FFC 16 is correspondingly increased in length.

The FFC 16 almost two times longer than a moving span of the liquid ejecting head 2 is used so as not to interfere with smooth reciprocating motions of the liquid ejecting head 2. However, there are parasitic impedance components that are proportional to the length of the FFC 16. Because the liquid ejecting head 2 in the LFP naturally increases in width in the main scanning direction, the FFC 16 is extended as long as approximately 4 m and impedance components are correspondingly increased, which is schematically shown in FIG. 3. In the drawing, numeral 19 denotes a variable capacitance representing the analog switches 12 through 14 and the actuators 9 through 11 of FIG. 1, numerals 20 and 21 denote parasitic inductance components, and numerals 48 and 49 denote parasitic resistance components, each of which is present in the conduction patterns 17 of FIG. 1. The inductance components give rise to a back electromotive force that is proportional to differentiation of a current flowing through the FFC 16 with respect to time. However, when a quantity of the current increases, so does the differentiation of the current with respect to time. Thus, when a capacitance load increases, so does the back electromotive force in magnitude. Accordingly, when the FFC 16 is increased in length, as shown in FIG. 4A, there occurs a phenomenon that discrepancy is caused between a driving signal waveform in the vicinity of the emitters of the transistors 5 and 6 in the main body 1 and a driving signal waveform across the variable capacitance 19. This raises a problem that the driving voltage specified in driving voltage information ID is not applied to the piezoelectric vibrators. In particular, because the inductance components give rise to an overshoot and an undershoot of a voltage in the ejecting head 2, a driving voltage substantially higher than a voltage appropriate for driving the piezoelectric vibrators is applied. Values larger than appropriate values are thus given to a liquid droplet ejecting speed and a discharged liquid droplet weight. This means that the position and the size of a dot formed on the surface of a sheet of paper through discharge differ with the number of nozzles from which liquid droplets are ejected for one pulse, and the printing quality is adversely influenced.

On the other hand, as shown in FIG. 4B, the resistance components of the FFC 16 become a factor that causes a voltage drop and a delay in response when the piezoelectric vibrators are charged and discharged. When a current flowing through the FFC 16 increases, a voltage on the variable capacitance 19 side drops, and contrary to the inductance components, the piezoelectric vibrators are driven on a voltage substantially lower than the driving voltage specified in the driving voltage information ID. Values smaller than appropriate values are thus given to a liquid droplet ejecting speed and an ejected liquid droplet weight. Also, in the case of printing at a printing quality as high as a picture quality, a liquid droplet weight per dot needs to be reduced to approximately 5 ng. However, for such a minute liquid droplet to be ejected, it becomes essentially necessary to drive the piezoelectric vibrators to cause displacement at a higher speed than in the case of ejecting a related large liquid droplet (10 to 40 ng). To displace the piezoelectric vibrators at a high speed, a charging and discharging time of a driving signal has to be shortened, and naturally a change rate with respect to time and an absolute value of a current are increased, which in turn increases distortion due to the impedance components of the FFC 16. The impedance components of the FFC 16 need to be reduced as small as possible to solve such a problem. However, there is a limit to a reduction of the impedance components because of the restriction of a conducting line width and a length of the FFC 16. It should be noted that, as a matter of course, it is impossible to shorten the FFC 16 in the LFP, and increasing the conducting line width or the number of cores of the FFC 16 results in an increase of the cost of the liquid ejecting apparatus main body 1.

SUMMARY OF THE INVENTION

The invention was devised to solve the foregoing problems, and therefore has an object to provide a liquid ejecting apparatus that enables the use of a liquid ejecting head of the same structure and a driving signal waveform used therein for various types of apparatus each using the FFC of a different length while maintaining a high printing quality, by correcting a change in a reference driving voltage of piezoelectric vibrators caused by a difference in inductance components L and resistance components R of the conduction patterns between the FFCs in a case where the same ejecting head is used to another type of apparatus using the FFC of a different length. It should be noted that, in order to adapt the liquid ejecting apparatus to a temperature environment at a site where the liquid ejecting apparatus is to be installed, a correction in temperature is applied to a driving voltage of the piezoelectric vibrators with reference to a driving voltage of the liquid ejecting head.

A correction coefficient is calculated using a ratio of a voltage (specified in driving voltage information ID) obtained in the measuring step of a voltage needed to drive piezoelectric vibrators and a voltage (reference driving voltage) applied when printing is performed by attaching a liquid ejecting head to a liquid ejecting apparatus main body to be actually used, so that a voltage is corrected on the liquid ejecting apparatus main body side. It is thus possible to use the liquid ejecting head of a reference type and a driving signal waveform used therein to another type of apparatus using an FFC of a different length without the need to newly start up the measuring step of a voltage for each type of apparatus and without the need to improve the driving signal waveform.

Particularly, in order to achieve the above object, according to the present invention, there is provided a liquid ejecting apparatus, comprising:

a liquid ejecting head, formed with a nozzle opening from which a liquid droplet is ejected, and having a driving voltage information ID in a reference state specific to each liquid ejecting head;

a pressure generating chamber, communicating with the nozzle opening;

a piezoelectric vibrator, expanding and contracting the pressure generating chamber;

a driving signal generator, generating a driving signal to displace the piezoelectric vibrator;

a switch, selectively applying the driving signal to the piezoelectric vibrator based on liquid ejecting data; and a flexible flat cable, transmitting the driving signal to the piezoelectric vibrator, wherein a voltage obtained by adding a correction coefficient to a voltage specified in the driving voltage information ID is used as a reference driving voltage.

Preferably, the correction coefficient is set in accordance with a length of the flexible flat cable.

Preferably, the driving signal has a plurality of different driving signal waveforms for ejecting liquid droplets of different sizes, and the correction coefficient is set in accordance with difference of the driving signal waveforms.

Preferably, the driving signal generator generates a plurality of driving signals having a different driving signal waveforms, and the correction coefficient is set in accordance with difference of the driving signal waveforms of the driving signals.

Preferably, the correction coefficient is set in accordance with capacitance of the piezoelectric vibrator.

Preferably, the correction coefficient is set in accordance with material of the piezoelectric vibrator.

Preferably, the correction coefficient is set in accordance with a kind of liquid to be ejected.

Preferably, the correction coefficient is set in accordance with a kind of color of the liquid to be ejected.

According to the present invention, there is also provided a liquid ejecting apparatus, comprising:

a liquid ejecting head, formed with a nozzle opening from which a liquid droplet is ejected;

a pressure generating chamber, communicating with the nozzle opening;

a driving signal generator, generating a driving signal to drive the pressure generator; and a signal applier, applying the driving signal to the pressure generator based on liquid ejecting data, wherein the liquid ejecting head has driving voltage information in a reference state specific to each liquid ejecting head; and wherein the driving signal generator generates the driving signal based on the driving voltage information and a correction coefficient.

[Function]

In a plurality of liquid ejecting apparatuses each using the FFC of a different length, an appropriate reference driving voltage of the piezoelectric vibrators is set in each type of liquid ejecting apparatus to correct a change in the reference driving voltage associated with a change in inductance components L and resistance components R of conduction patterns between the FFCs without the need to newly start up the measuring step of a driving voltage, and an appropriate driving signal waveform is thereby applied to the piezoelectric vibrators. It is thus possible to prevent irregularity in a liquid droplet ejecting speed and an ejected liquid droplet weight due to a difference in the reference driving voltage needed to drive the piezoelectric vibrators, and as a consequence, deterioration in printing quality can be prevented.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The following description will describe one embodiment of the invention in detail with reference to the accompanying drawings.

Figure 1:
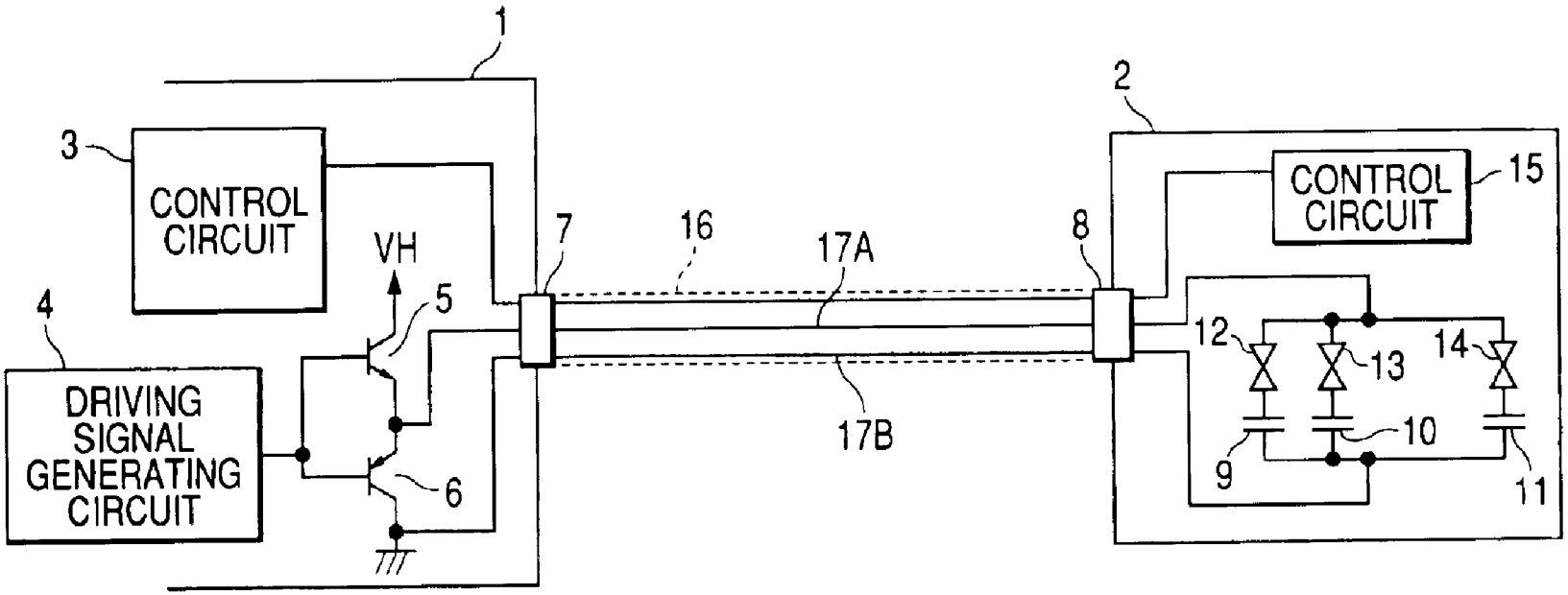
FIG. 1 is a view showing an arrangement of a liquid ejecting system representing one embodiment in the related art.
Figure 2:
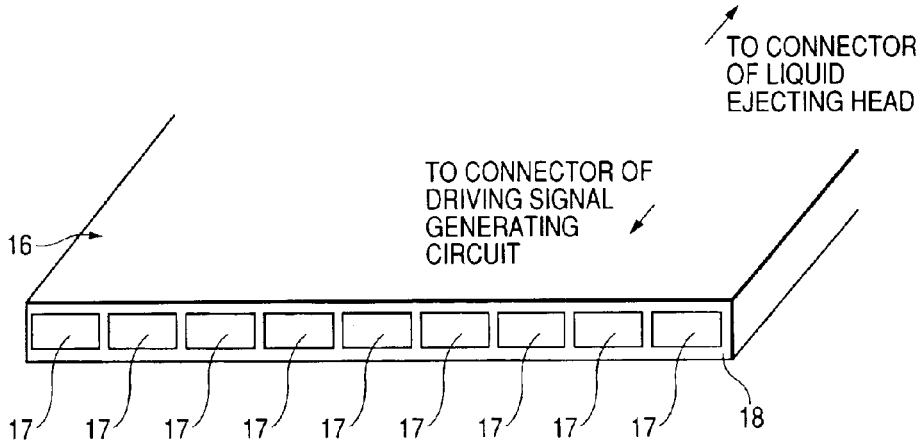
FIG. 2 is a cross section of a flexible flat cable.
Figure 3:
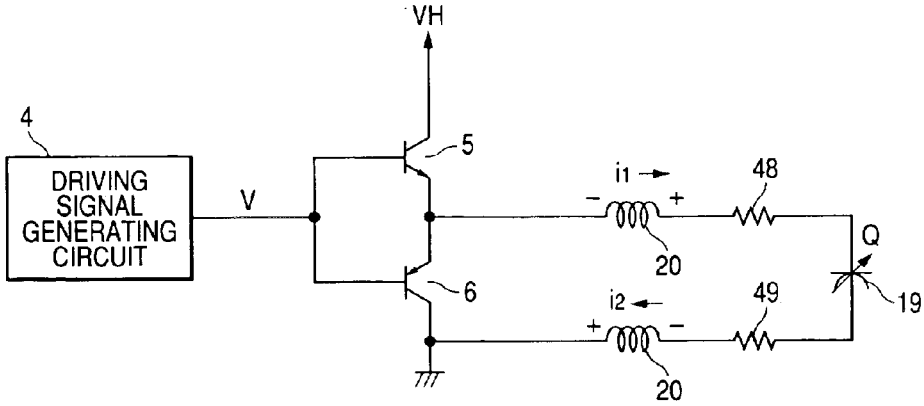
FIG. 3 is an explanatory view showing a simplified arrangement of FIG. 1.
Figure 4A:
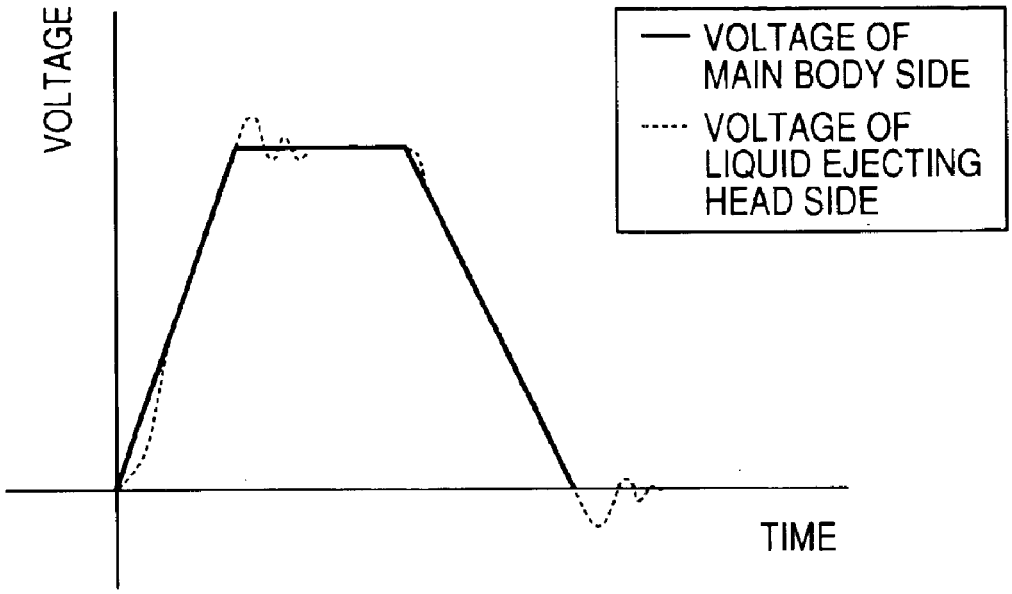
FIG. 4A and FIG. 4B are views showing driving electric signals of a liquid ejecting apparatus main body and a liquid ejecting head arranged as shown in FIG. 1, FIG. 4A showing influence of inductance components and FIG. 4B showing influence of resistance components.
Figure 4B:
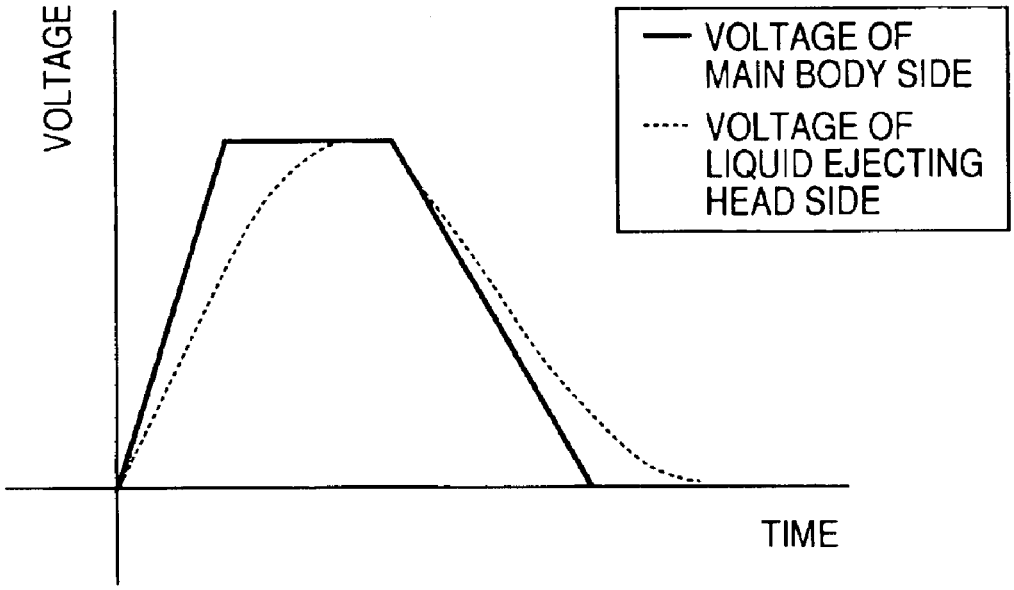
Figure 5:
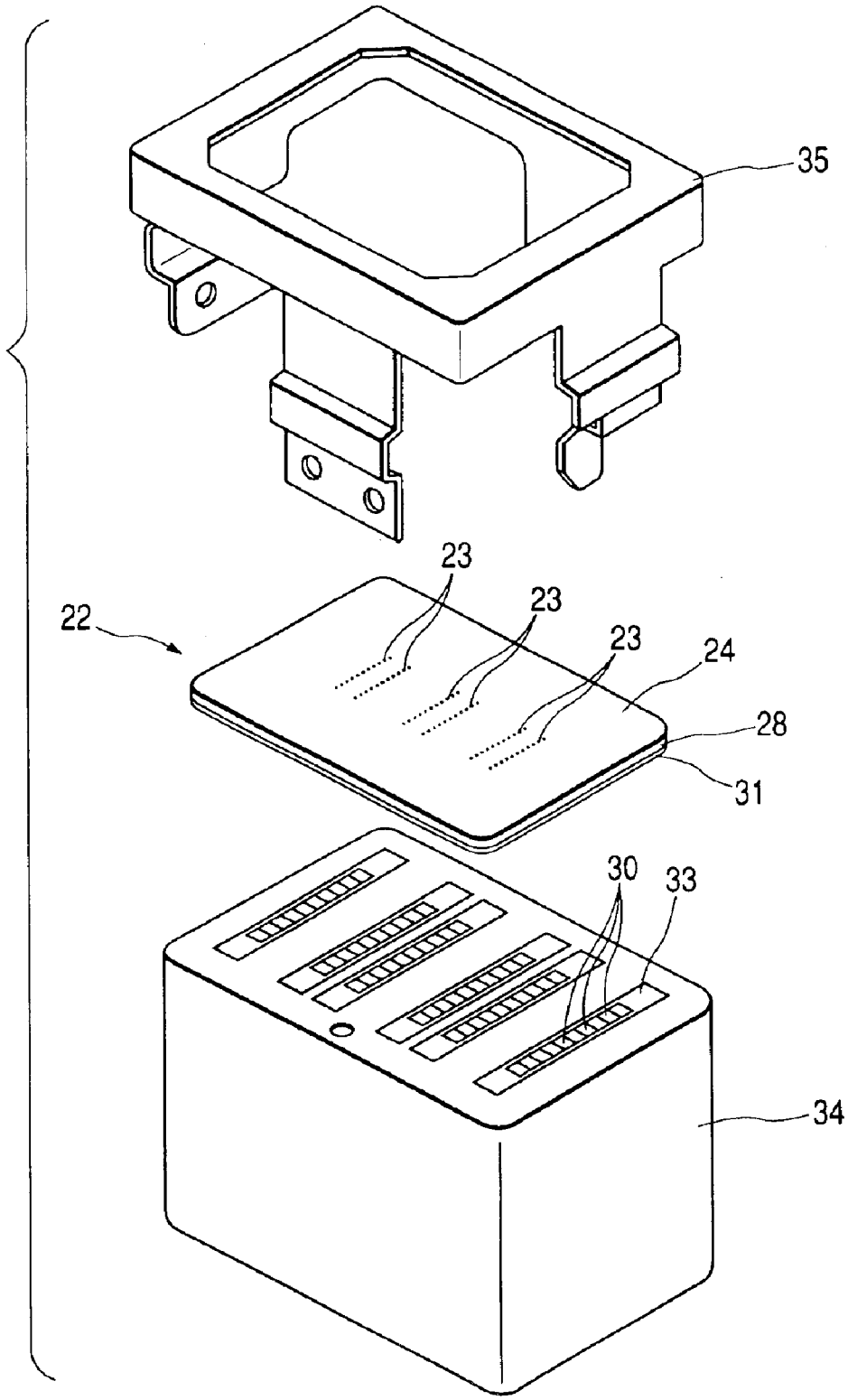
FIG. 5 is a perspective view of an assembly showing one embodiment of a liquid ejecting head of the invention.
Figure 6:
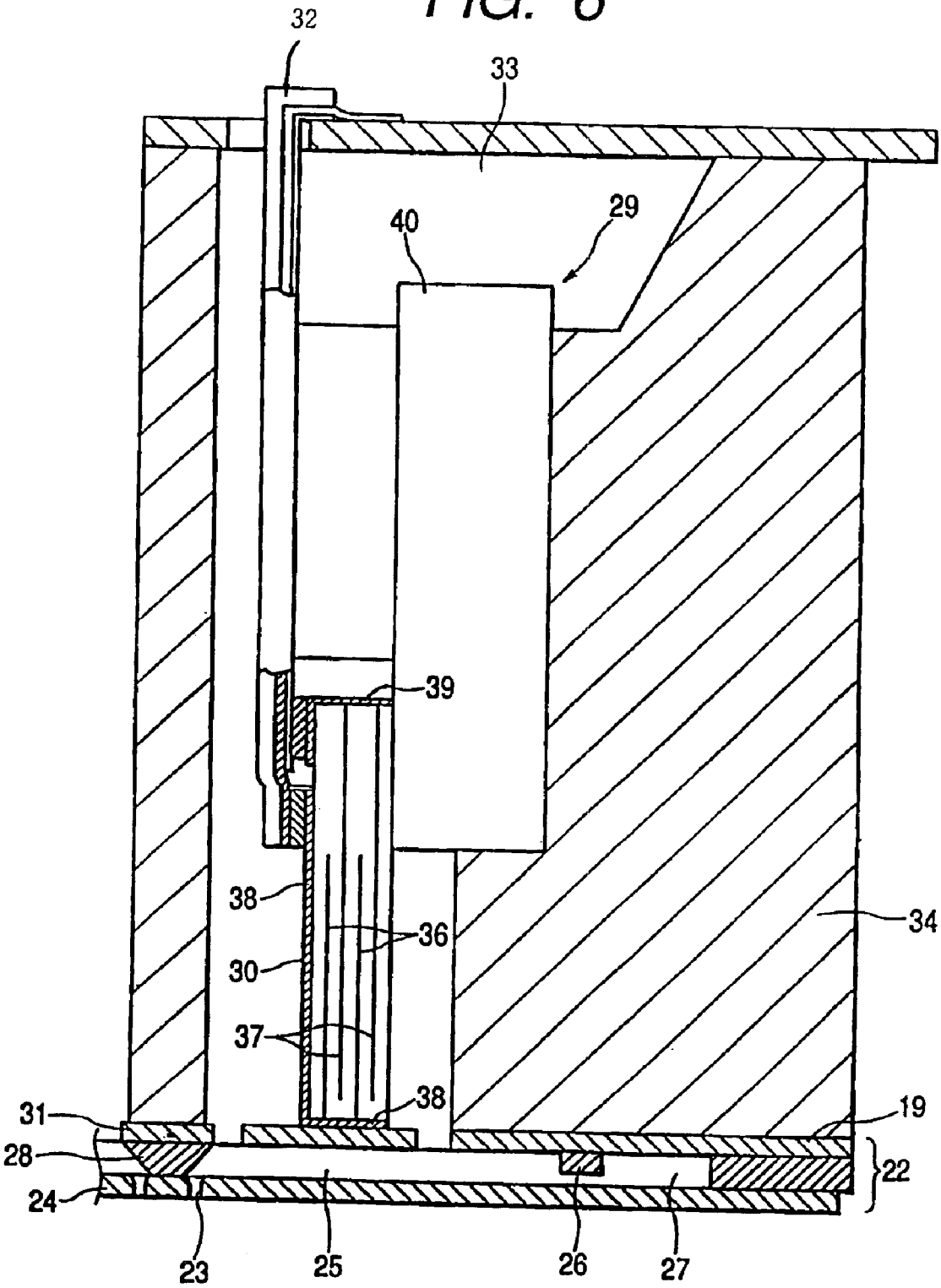
FIG. 6 is a view showing a cross-sectional structure at a segment electrode of the liquid ejecting head of the invention.
Figure 7:
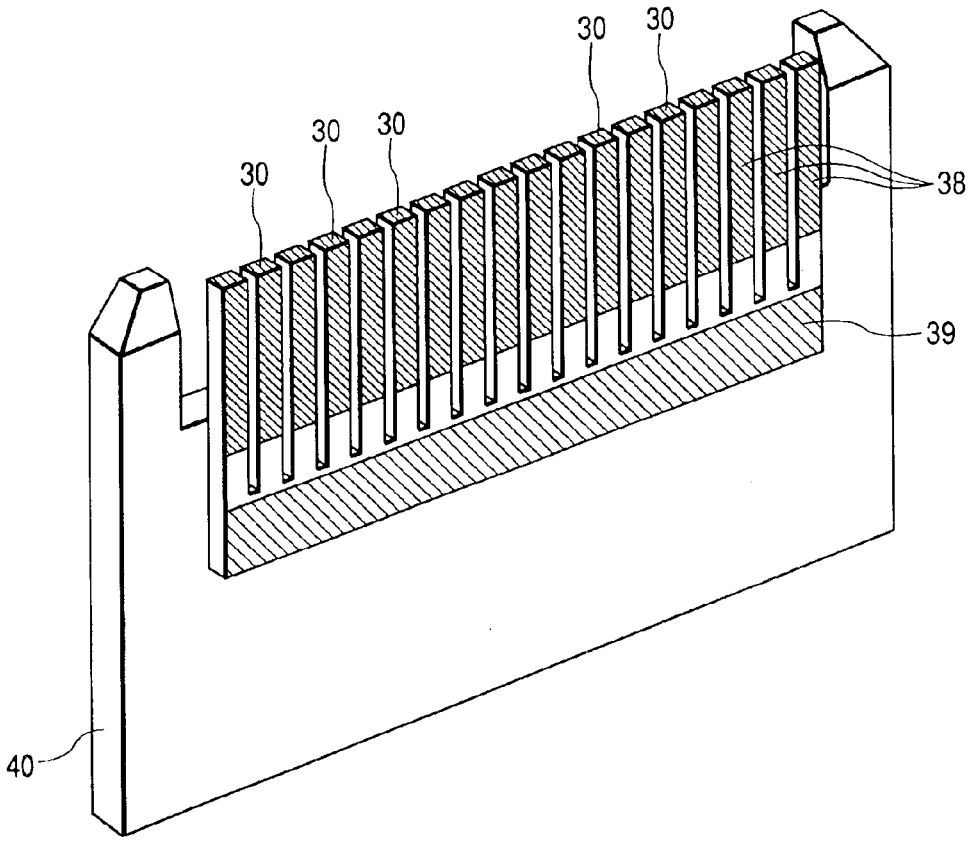
FIG. 7 is a view showing one embodiment of a vibrating unit.

FIG. 5 and FIG. 6 are views showing one example of a schematic structure of a liquid ejecting apparatus. A flow channel unit 22 is formed by integrally laminating a nozzle plate 24 in which nozzle openings 23 are made at regular pitches, pressure generating chambers 25 that communicate with the corresponding nozzle openings 23, a flow channel formation substrate 28 provided with reservoirs 27 that supply liquid to the pressure generating chambers 25 through liquid supply openings 26, and an elastic plate 31 that abuts against the tip ends of respective piezoelectric vibrators 30 in a longitudinal vibrating mode within a corresponding piezoelectric vibrating unit 29 and thereby expands and contracts the pressure generating chambers 25 in volume. Each piezoelectric vibrating unit 29 is accommodated and fixed in an accommodation chamber 33 while being connected to a cable 32 that transmits a driving signal from an external apparatus. The flow channel unit 22 is fixed to an opening plane of a holder 34 made of a polymeric material through injection molding or the like with a frame body 35 serving also as a shielding member being inserted on the nozzle plate 24 side, and is formed at the liquid ejecting head 2. In this embodiment, each of the piezoelectric vibrators 30 in the longitudinal vibrating mode that form the corresponding piezoelectric vibrating unit 29 is formed by alternately laminating internal electrodes 36 used as one pole and internal electrodes 37 used as the other pole with piezoelectric materials 38 being sandwiched in between. The internal electrodes 36 are exposed at the top end side and the other internal electrodes 37 are exposed at the rear end side, so that they are connected respectively to a segment electrode 38 and a common electrode 39 at the respective end faces. As shown in FIG. 7, the piezoelectric vibrators 30 are fixed to a fixing substrate 40 to correspond with alignment pitches of the corresponding pressure generating chamber 25 and unified in the piezoelectric vibrating unit 29. In this embodiment, the piezoelectric vibrators 30 are formed by dividing a single piezoelectric vibrating plate in a shape of comb teeth connected at the rear ends, and the common electrode 39 for the respective piezoelectric vibrators 30 is formed as a continuum. The connector 8 of the liquid ejecting head 2 and the connector 7 of the driving signal generating circuit 4 of FIG. 1 are connected to each other via the FFC 16, and a driving signal waveform is transmitted to the liquid ejecting head 2 through the FFC 16, whereby liquid droplets are ejected on the surface of a recording medium by expanding and contracting the piezoelectric vibrators 30.

Figure 8A:
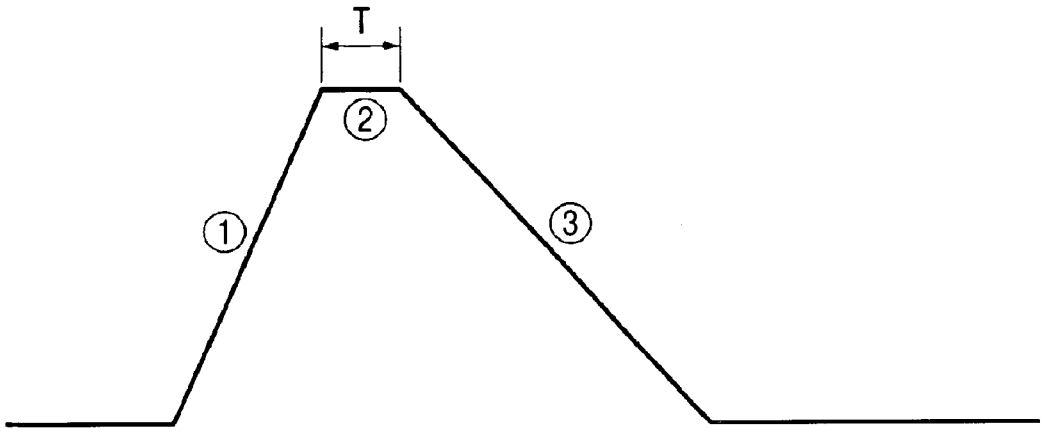
FIG. 8A is a view showing a driving electric signal from a driving signal generating circuit.
Figure 8B:
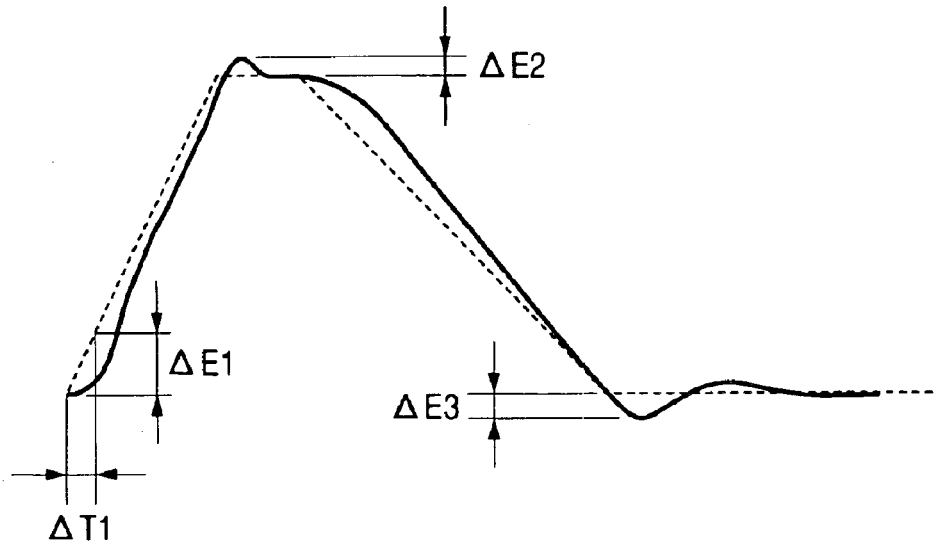
FIG. 8B is a view showing a driving electric signal to be applied to piezoelectric vibrators through a related flexible flat cable.

In this embodiment, when a trapezoidal driving signal waveform as shown in FIG. 8A is outputted from the driving signal generating circuit 4, the driving signal waveform is applied to particular piezoelectric vibrators 30 to be used in ejecting liquid droplets, through the use of semiconductor integrated circuit. The piezoelectric vibrators 30 are contracted with a rising portion of the driving signal waveform to expand the corresponding pressure generating chamber 25, whereby liquid is supplied to the pressure generating chamber 25 through the liquid supply opening 26. After the pressure generating chamber 25 is maintained in the expanded state for a predetermined time with a flat portion, the piezoelectric vibrators 30 are discharged with a falling portion, whereby the piezoelectric vibrators 30 elongate and restore to the original state to contract the pressure generating chamber 25, whereupon liquid droplets are ejected through the nozzle opening 23. In a driving method of controlling a liquid droplet weight by positively utilizing kinetic phases of meniscus induced by expansion of the pressure generating chamber 25 with the rising portion of the driving signal waveform, a time T of the flat portion of the driving signal waveform as described above is manipulated. In particular, in the case of ejecting a liquid droplet having a liquid droplet weight of approximately 5 ng, which is suitable to graphic printing, the time T becomes extremely short, and is set to, for example, as short as approximately 2 $\mu$s. Under these circumstances, electric capacitances of the piezoelectric vibrators 30 and inductance components of the transmission channel of the driving signal waveform, that is, the conduction patterns 17 in this embodiment, have a significant influence on a change rate of the rising and the falling of a current. To be more specific, when the driving signal waveform is applied, as shown in FIG. 8B, the inductance components give rise to a back electromotive force, $\Delta E1$, at the beginning of the rising portion, and apparently a current starts to flow after a time, $\Delta T1$, elapsed from the rising portion of the driving signal waveform. In a case where a ratio of the inductance components and the resistance of the conduction patterns 17 is not adjusted to an appropriate value. Further, the inductance components are relatively large, as shown in FIG. 8B, an overshoot occurs at the end of the rising portion due to an electromotive force, $\Delta E2$, induced by the inductance components. This tendency becomes noticeable when a current flowing through the FFC 16 is large, that is, when a large number of the piezoelectric vibrators 30 are driven concurrently. Hence, when a large number of the piezoelectric vibrators 30 are driven concurrently for a solid image (an image needing a large quantity of ejected ink) or the like, an ejecting speed of liquid droplets and a liquid droplet weight of a liquid droplet are increased, which often causes bending of flight, a missing dot, etc. These phenomena occur with the falling portion of the driving signal waveform as well. In particular, when the time T of the flat portion is shortened to discharge a microscopic liquid droplet, a waveform falls abruptly from the overshoot portion to the undershoot portion. This makes relative distortion of the driving signal waveform larger, and changes the discharge characteristic of a liquid droplet considerably. In the drawing, a dotted line represents a driving signal waveform needed to drive the piezoelectric vibrators 30, and a solid line represents a driving signal waveform actually inputted into the piezoelectric vibrators 30.

Hence, in this embodiment, as will be described below, an appropriate reference driving voltage is inputted into the liquid ejecting head 2 regardless of the types of liquid ejecting apparatus, by setting a voltage correction coefficient used to correct a change in the reference driving voltage of the piezoelectric vibrators 30 caused by a change in the inductance L and the resistance R due to a length of the FFC 16 used to connect the driving signal generating circuit 4 to the liquid ejecting head 2 that varies with types of liquid ejecting apparatus. Consequently, a quantity of displacement and a speed of displacement of the piezoelectric vibrators 30 can be maintained at nearly constant levels, which enables printing at a high printing quality.

Figure 9:
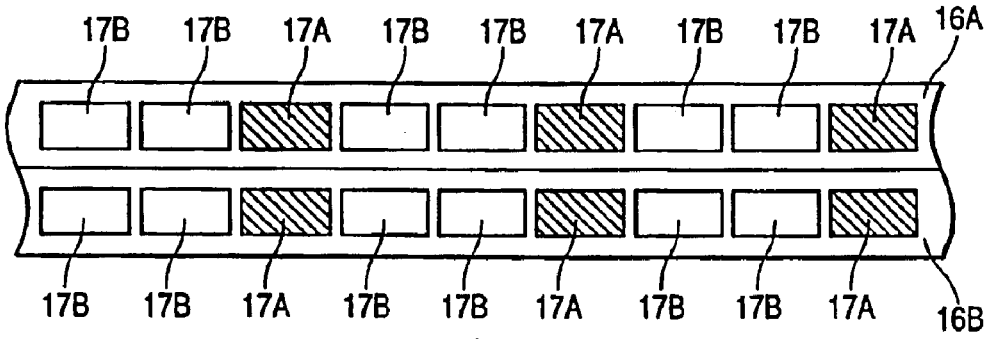
FIG. 9 is a cross section showing one example of a flexible flat cable.

As shown in FIG. 9, the FFC 16 that transmits a driving signal waveform from the driving signal generating circuit 4 to the liquid ejecting head 2 is of a laminated structure including a first FFC 16A and a second FFC 16B. The FFC 16 is shaped like a strip, including a number of conducting lines used as conduction patterns 17 that are aligned in parallel to one another and molded in synthetic resin 18 having good flexibility and durability to withstand bending deformation. In order to provide the conducting patterns 17 with the same durability as that of the synthetic resin 18, the conduction patterns 17 include a thin-plate member made of copper alloy, patterned into narrow slips, and have a thickness of 30 to 100 $\mu$m.

Referring to FIG. 9, the hatched conduction patterns 17 are positive conduction patterns 17A and the open conduction patterns 17 are negative conduction patterns 17B. One positive conduction pattern 17A (COM A) and two negative conduction patterns 17B (GND A) form one set, through which a driving signal waveform for the piezoelectric vibrators 30 (those for a color assigned to the row A) assigned with liquid of a given color is transmitted to the ejecting head 2. The conduction patterns 17 in each set are placed sequentially with regularity. When there are six sets (rows A through F), one of which is shown in FIG. 8, liquid of six colors in total is ejected in correspondence with the piezoelectric vibrators 30 in six rows. The most basic arrangement of colors of liquid assigned to six rows includes black, cyan, magenta, yellow, light cyan, and light magenta.

The FFC 16 includes earth lines, temperature-detecting signal lines, other driving power supply lines, etc. in addition to the driving signal lines of the piezoelectric vibrators 30.

It should be noted that because the conducting lines of the FFC 16 of the laminated structure are extremely thin, the resistance R per unit area of a current flowing through the conducting lines increases significantly, which in turn reduces a ratio of the inductance components L and the resistance R. Also, because there is only one positive conduction pattern 17A in each conducting line, a quantity of a current flowing through the conducting line is increased, which becomes a factor causing an overshoot and an undershoot in a driving signal waveform to be applied to the piezoelectric vibrators 30 because of the largeness of the inductance components L. Hence, there occurs a phenomenon that an exact driving signal waveform as requested is not inputted into the piezoelectric vibrators 30. The occurrence of the overshoot and the undershoot triggers a phenomenon that discrepancy is caused between a voltage actually applied to the piezoelectric vibrators 30 and an appropriate reference driving voltage that needs to be applied. When an appropriate reference driving voltage is not applied to the piezoelectric vibrators 30, a target liquid droplet weight is not ejected in association with a change in quantity of displacement, which results in deterioration in printing quality.

Accordingly, in the invention, as set forth in Table 1 below, a correction coefficient is calculated using a ratio (V2/V1) of a driving voltage (V1) of the piezoelectric vibrators 30 calculated in the liquid ejecting head inspecting step and given to the liquid ejecting head 2 as specific driving voltage information ID, and an appropriate reference driving voltage (V2) applied when printing is performed by actually attaching the liquid printing head 2 to the liquid ejecting apparatus main body 1. A voltage is then corrected on the liquid ejecting apparatus main body 1 side using the correction coefficient thus calculated, and an appropriate reference driving voltage is thereby applied to the piezoelectric vibrators 30. It is thus possible to prevent deterioration in printing quality associated with a change in liquid droplet weight. Herein, the correction coefficient is calculated and set for respective ejecting modes in which liquid droplets are ejected with different driving signal waveforms.

TABLE 1

Method of Determining Correction Coefficient

| Liquid droplet Ejecting Mode | Voltage V1 | Voltage V2 | Correction Coefficient |
|---|---|---|---|
| Mode 1 | 27.5 | 25.5 | 0.93 |
| Mode 2 | 23.0 | 22.0 | 0.96 |
| Mode 3 | 25.5 | 24.3 | 0.95 |

Voltage V1: driving voltage (V) found in liquid ejecting head inspecting step
Voltage V2: reference driving voltage (V) applied when printing is performed by actually attaching liquid ejecting head to liquid ejecting apparatus
Correction Coefficient = voltage V2/voltage V1

As a correction method in this embodiment, by setting specific, pre-calculated correction coefficients in each type of liquid ejecting apparatus in the control circuit 3 of the liquid ejecting apparatus main body 1, correction is made upon input of a driving voltage measured individually in the liquid ejecting head inspecting step and specified in the driving voltage information ID, whereupon the reference driving voltage is determined.

Also, as set forth in Table 2 below, the reference driving voltage differs depending on the kinds of liquid materials, such as dyes and pigments, and it is necessary to calculate and set correction coefficients that best suit the respective kinds of liquid materials. Also, the correction coefficient differs slightly depending on the materials and capacitances of the piezoelectric vibrators 30 (piezoelectric vibrator ranks). It is thus necessary to calculate and set correction coefficients depending on the piezoelectric vibrator ranks. This is because a voltage-displacement characteristic differs depending on the materials of the piezoelectric vibrators 30, while a difference in capacitance causes a difference in quantity of a current flowing through the FFC 16, which makes a difference in the way the driving signal waveform deforms.

TABLE 2

Correction Coefficient Table
(for each kind of ink and each piezoelectric vibrator rank)

| Piezo-electric vibrator | Dye Ink | | | Pigment Ink | | |
|---|---|---|---|---|---|---|
| rank | Mode 1 | Mode 2 | Mode 3 | Mode 1 | Mode 2 | Mode 3 |
| 0 | 0.93 | 0.96 | 0.95 | 0.95 | 0.93 | 1.01 |
| 1 | 0.92 | 0.93 | 0.94 | 0.93 | 0.93 | 1.01 |
| 2 | 0.93 | 0.95 | 0.95 | 0.95 | 0.95 | 1.02 |
| 3 | 0.92 | 0.94 | 0.95 | 0.93 | 0.94 | 1.01 |

Further, in the case of pigment ink, a liquid droplet weight of ejected ink may differ depending on colors of ink. The pigment ink behaves as non-Newtorian fluid having different viscosities depending on a driving frequency, and a degree of the change in viscosity differs among colors having different pigment densities. Hence, a liquid droplet weight of ink to be ejected differs from color to color. However, with the liquid ejecting apparatus having driving circuits for respective colors, by setting correction coefficients for respective colors, it is possible to prevent a change in liquid droplet weight of discharged ink depending on colors of ink.

Figure 10:
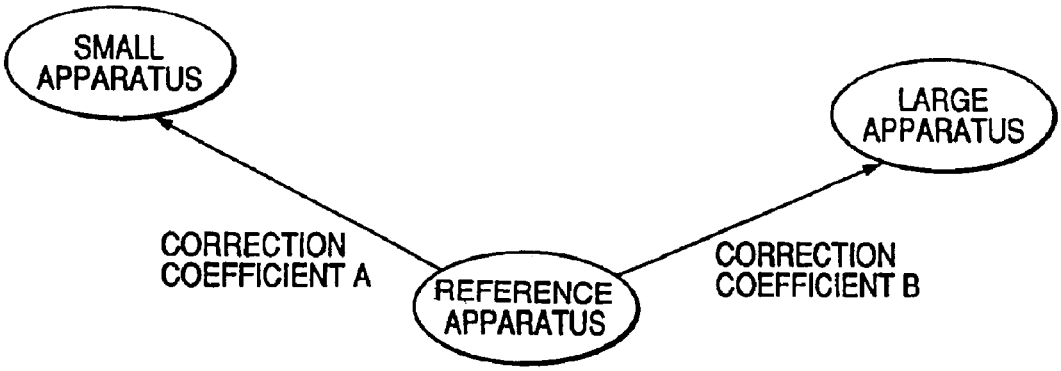
FIG. 10 is a conceptual view in setting a correction coefficient of a driving voltage according to the invention.

As shown in FIG. 10, the correction coefficient can be set to best suit the respective types of apparatus regardless of the way in which an adapted apparatus is changed from the apparatus of the reference type. Hence, it is no longer necessary to newly start up the liquid ejecting head inspecting step even in a case where the same liquid ejecting head and driving signal waveform are used for a different type of apparatus.

As has been described above, in a plurality of liquid ejecting apparatuses each including: a liquid ejecting head provided with piezoelectric vibrators that expand and contract a pressure generating chamber communicating with a nozzle opening through which a liquid droplet is discharged, driving signal generator for generating a driving signal waveform used to displace the piezoelectric vibrators, a switch for selectively applying the driving signal to the piezoelectric vibrators in correspondence with printing data, and an FFC that transmits the driving signal to the piezoelectric vibrators, in order to correct a change in a reference driving voltage due to a difference in a ratio, L/R, where L($\mu$H) is inductance components and R($\Omega$) is resistance components between the driving signal generating circuit and the liquid ejecting head, formed in the FFC that transmits a driving signal waveform to the liquid ejecting head, a correction coefficient is calculated and set using a ratio of a driving voltage measured in the liquid ejecting head inspecting step and specified in driving voltage information ID and a driving voltage applied when printing is performed by actually attaching the liquid ejecting head to the liquid ejecting apparatus. It is thus possible to prevent deterioration in printing quality caused by a variance of a discharged liquid droplet weight.

Consequently, a liquid ejecting head designed and manufactured for a consumer apparatus and a driving signal waveform used therein can be used for various other types of apparatus each using the FFC of a different length. Also, the liquid ejecting head can be used to any other type of apparatus without the need to improve the existing liquid ejecting head inspecting step, and as a consequence, both the cost and a time needed to develop the liquid ejecting apparatus can be saved.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejecting apparatus, comprising:

a liquid ejecting head, formed with a nozzle opening from which a liquid droplet is ejected, and having a driving voltage information ID in a reference state specific to the liquid ejecting head;

a pressure generating chamber, communicating with the nozzle opening;

a piezoelectric vibrator, expanding and contracting the pressure generating chamber;

a driving signal generator, generating a driving signal to displace the piezoelectric vibrator;

a switch, selectively applying the driving signal to the piezoelectric vibrator based on liquid ejecting data; and a flexible flat cable, transmitting the driving signal to the piezoelectric vibrator, wherein a voltage obtained by adding a correction coefficient to a voltage specified in the driving voltage information ID is used as a reference driving voltage for driving the liquid ejecting head; and wherein the correction coefficient is set in accordance with a length of the flexible flat cable.

2. The liquid ejecting apparatus as set forth in claim 1, wherein the driving signal has a plurality of different driving signal waveform for ejecting liquid droplets of different sizes; and wherein the correction coefficient is set in accordance with difference of the driving signal waveforms.

3. The liquid ejecting apparatus as set forth in claim 1, wherein the driving signal generator generates a plurality of driving signals having a different driving signal waveforms; and wherein the correction coefficient is set in accordance with difference of the driving signal waveforms of the driving signals.

4. The liquid ejecting apparatus as set forth in claim 1, wherein the correction coefficient is set in accordance with capacitance of the piezoelectric vibrator.

5. The liquid ejecting apparatus as set forth in claim 1, wherein the correction coefficient is set in accordance with material of the piezoelectric vibrator.

6. The liquid ejecting apparatus as set forth in claim 1, wherein the correction coefficient is set in accordance with a kind of liquid to be ejected.

7. The liquid ejecting apparatus as set forth in claim 1, wherein the correction coefficient is set in accordance with a kind of color of the liquid to be ejected.

8. A liquid ejecting apparatus, comprising:

a liquid ejecting head, formed with a nozzle opening from which a liquid droplet is ejected;

a pressure generating chamber, communicating with the nozzle opening;

a driving signal generator, generating a driving signal to drive the pressure generator; and a signal applier, applying the driving signal to a pressure generator based on liquid ejecting data, wherein the liquid ejecting head has driving voltage information in a reference state specific to the liquid ejecting head;

wherein the driving signal generator generates the driving signal based on the driving voltage information and a correction coefficient; and wherein the correction coefficient is set in accordance with a length of flexible flat cable.

* * * * *